US008857336B2

(12) United States Patent
Berg

(10) Patent No.: US 8,857,336 B2
(45) Date of Patent: Oct. 14, 2014

(54) TRANSPORTING A WEB THROUGH A PRESS

(75) Inventor: Mark H Berg, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 413 days.

(21) Appl. No.: 13/259,045

(22) PCT Filed: Nov. 30, 2009

(86) PCT No.: PCT/US2009/066128

§ 371 (c)(1),
(2), (4) Date: Sep. 22, 2011

(87) PCT Pub. No.: WO2011/065959

PCT Pub. Date: Jun. 3, 2011

(65) Prior Publication Data

US 2012/0024173 A1 Feb. 2, 2012

(51) Int. Cl.

| | |
|---|---|
| ***B41F 33/00*** | (2006.01) |
| ***B41J 11/00*** | (2006.01) |
| ***B41J 3/60*** | (2006.01) |
| ***B41J 15/16*** | (2006.01) |

(52) U.S. Cl.
CPC . *B41J 3/60* (2013.01); *B41J 15/165* (2013.01)
USPC ..... 101/483; 101/485; 400/611; 400/619; 347/104

(58) Field of Classification Search
CPC ..... B41F 13/02; B41F 13/06; B41F 9/003; B41F 9/023; B41F 9/025; B41F 9/026; B41F 9/028; B65H 23/32; B41J 15/00; B41J 15/005; B41J 15/04; B41J 15/046
USPC ..... 101/219, 220, 223, 483, 485; 400/611, 400/619; 347/101, 102, 103, 105
See application file for complete search history.

(56) References Cited

U.S. PATENT DOCUMENTS

| | | | | |
|---|---|---|---|---|
| 772,695 | A * | 10/1904 | Crowell | 118/65 |
| 3,239,948 | A * | 3/1966 | Di Mino | 34/657 |
| 4,102,058 | A * | 7/1978 | Foster, Sr. | 34/629 |
| 5,483,886 | A | 1/1996 | Hauer | |
| 5,812,151 | A * | 9/1998 | Kishine et al. | 346/44 |
| 6,079,330 | A | 6/2000 | Aoki et al. | |
| 6,659,602 | B2 * | 12/2003 | Izawa et al. | 347/102 |
| 6,782,822 | B2 | 8/2004 | Verhoest et al. | |
| 2002/0186289 | A1 | 12/2002 | Tsuruta et al. | |
| 2009/0297245 | A1 * | 12/2009 | Godden et al. | 400/611 |
| 2011/0129275 | A1 * | 6/2011 | Joseph et al. | 400/611 |

FOREIGN PATENT DOCUMENTS

| | | | |
|---|---|---|---|
| JP | 63-159053 | A | 7/1988 |
| JP | 03255070 | B2 | 11/2001 |

* cited by examiner

*Primary Examiner* — Ren Yan

(57) ABSTRACT

A method, system and apparatus for transporting a web through a press are disclosed. The web has a first print zone on a first side and a second print zone on a second side opposite the first print zone. The first print zone is fed past a first print station and then in an inward spiraling direction around and toward a second print station. The second print zone is fed past the second print station and then in an outward spiraling direction.

15 Claims, 5 Drawing Sheets

TRANSPORTING A WEB THROUGH A PRESS

BACKGROUND

Digital web printers, commonly referred to as web presses, form images on both sides of a web. A given web press forms images in a first print zone on one side of the web at a first print station. Subsequently, the web is inverted, and the web press, at a second print station, forms another image on the other side of the web in a second print zone opposite the first. Typically, the two print stations are positioned end to end within the press. Such configurations lead to relatively large footprints and can be undesirable in environments with limited space.

Where the press uses ink to form the images, each side of the web is allowed to dry before that side is handled. Dry times depend on the type of printing. For example, ninety percent page coverage can require more dry time than ten percent coverage. Since the web moves through the press at a relatively constant velocity, dry times translate into distances. In other words, a print zone in which ink has been deposited travels a set distance before the print zone is handled and ink is deposited in an opposing print zone on the other side of the web. That opposing print zone then travels another set distance before being handled. The drying distances of conventional web presses are static and set with the presumption that maximum drying time is desired. Such static configurations are inefficient for applications such as text printing where little or no drying is called for.

DRAWINGS

Figure 1:
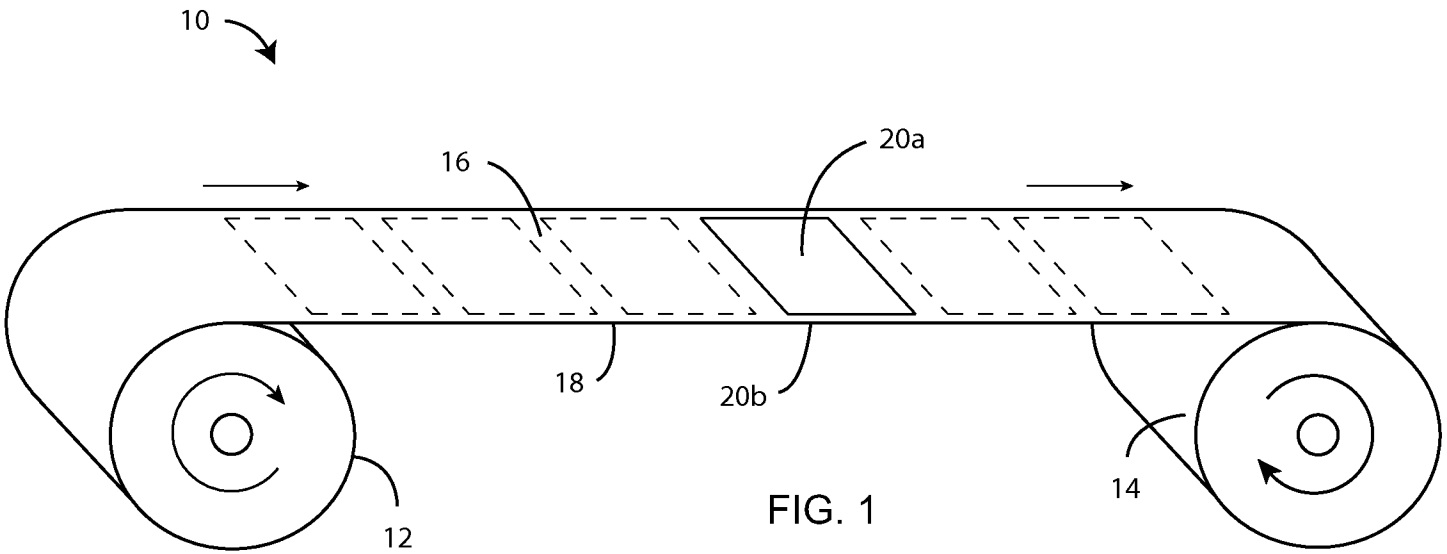

FIG. 1 depicts an exemplary web according to an embodiment.

Figure 2A:
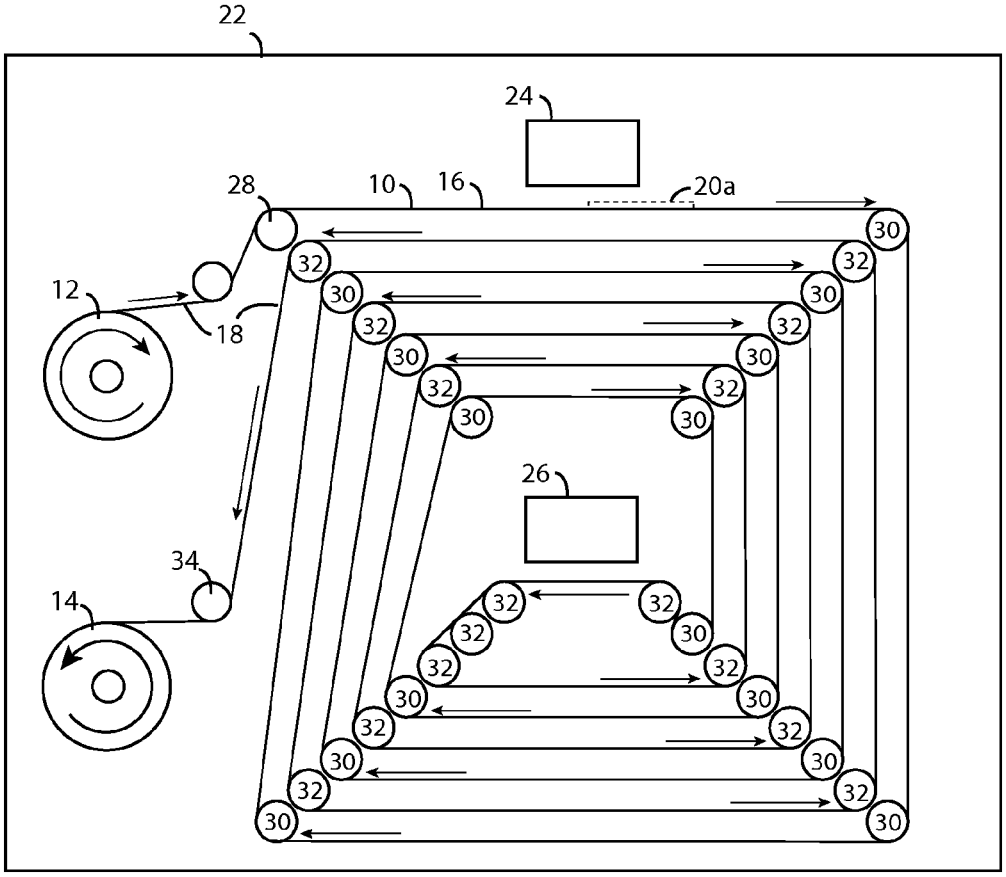
Figure 2B:
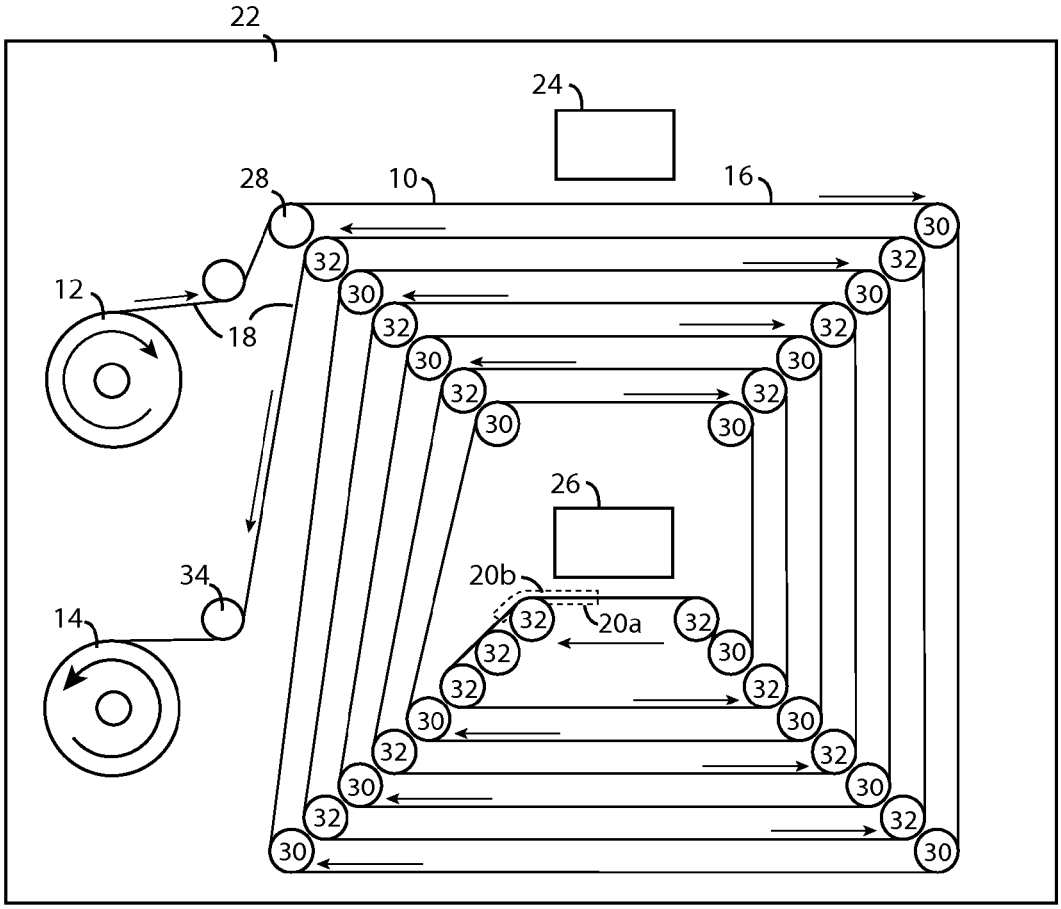
Figure 3:
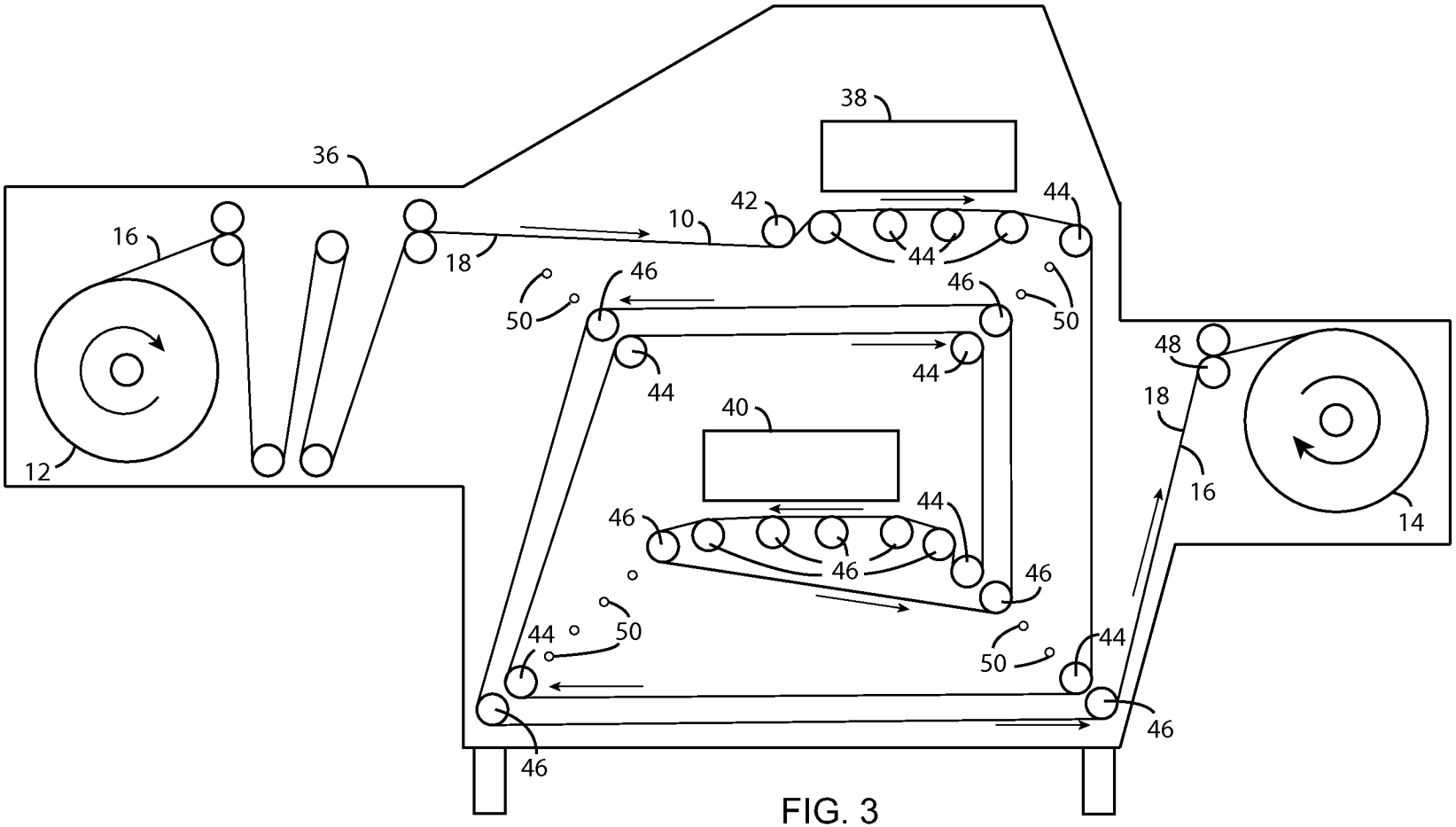

FIGS. 2A, 2B, and 3 depict web presses configured according to embodiments.

Figure 4:
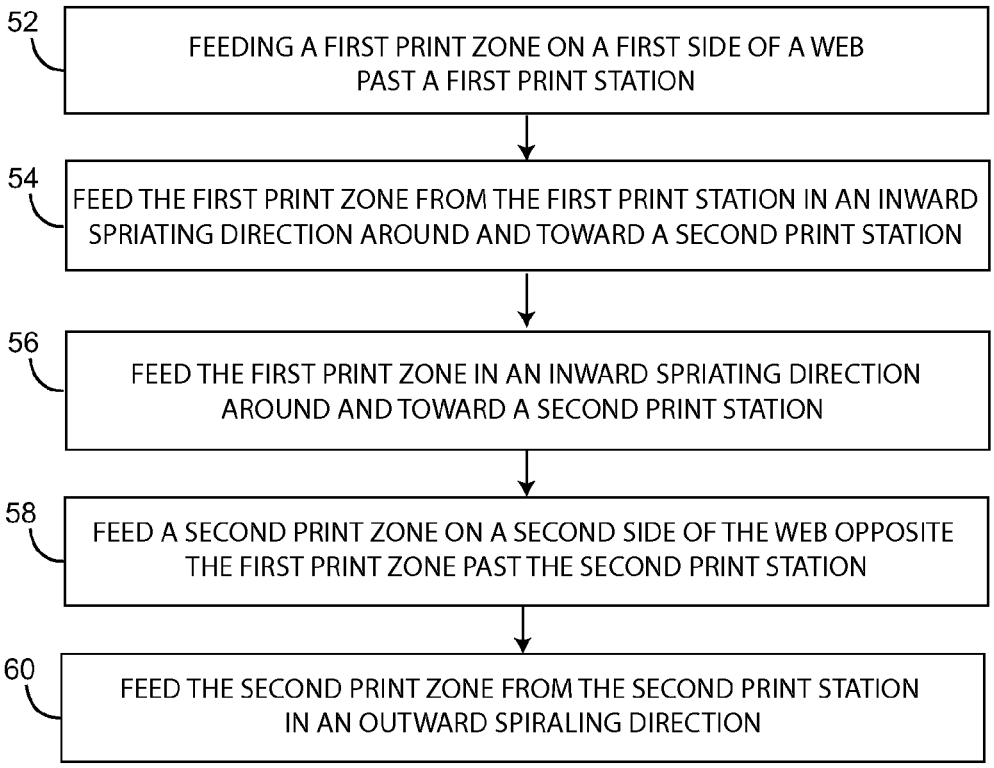

FIG. 4 is an exemplary flow diagram depicting steps taken to implement an embodiment.

DETAILED DESCRIPTION

Introduction: Various embodiments described below were developed in an effort to reduce the foot print of a web press while allowing for application specific drying distances. A web enters a press and is fed past a first print station where imaging material is deposited in a first print zone on a first side of the web. The first print zone is then fed from the first print station in an inward spiraling direction toward a second print station. The web is inverted and past through a second print station allowing imaging material to be deposited in a second print zone opposite the first print zone on a second side of the web. The second print zone is fed from the second print station in an outward spiraling direction. In various embodiments the distance traveled by a print zone in an inward or in an outward spiraling direction can be varied depending on a particular application.

The following description is broken into sections. The first, labeled "Web," describes an exemplary web that may be fed through a press according to various embodiments. The second section, labeled "Web Press," describes exemplary web press configurations according to embodiments. The third section, labeled as "Operation," describes steps taken to implement various embodiments.

Web: The term "web," as used herein, refers to a continuous roll of paper or other substrate on which images may be printed on one or both sides. Once formed, printed portions can be cut from the web and assembled as desired. FIG. 1 depicts an exemplary web 10. Web 10 is unwound from a supply spool 12, fed passed one or more print stations, discussed below, and, in this example, wound back up on take-up spool 14. Web 10 includes a first side 16 and a second side 18 on which images may be formed. The terms "first" and "second" when used with respect to sides web 10 are used simply to distinguish one side from the other. In other contexts, side 18 may be a first side and side 16 the second.

Images may be formed in print zones on one or both sides 16 and 18 of web 10. As used herein, a print zone is an area on a given side 16 or 18 of web 10. A given print zone on one side 16 or 18 of web 10 will have an opposing print zone on the other side 18 or 16. hi the example of FIG. 1, web 10 includes first print zone 20*a* and opposing second print zone 20*b*. Other print zones are shown in broken lines. The dimensions of a print zone can vary depending upon a particular application. For example, when producing a book, magazine, or other publication, a series of pages is formed on web 10, cut, and, bound. In such a case, the print zone dimension may correspond to the size of the printed page. Moreover, the print zones on web 10 may vary in size with respect to one another depending on the specifications of a particular job being printed.

Web Press: FIGS. 2A, 2B, and 3 depict exemplary web presses in which various embodiments may be implemented. Starting with FIGS. 2A and 2B, web 10 is loaded onto web press 22. FIG. 2A depicts web press 22 at a first time while FIG. 2B depicts web press 22 at a later time after web 10 has been fed a distance through web press 22. Web press 22 includes first print station 24 and second print station 26. Each print station 24, 26 represents generally a component or group of components configured to deposit imaging material in print zones on web 10. The imaging material, ink for example, may include one or more colors and is deposited in the form of desired images such as text and graphics. In a particular example, each print station 24 and 26 includes one or more print heads each capable of ejecting ink though selected nozzles.

Web press 22 includes input guide 28, first plurality of guides 30, second plurality of guides 32, and output guide 34. Guides 28-34 define a path that web 10 follows through web press 22 and may represent a series of active or passive rollers sharing parallel rotational axes. Of note is the "X" pattern formed by first and second plurality of guides 30 and 32 with second print station 26 positioned at its center. In the examples of FIGS. 2A and 2B, web 10 travels through web press 22 as follows:

- from supply spool 12 to input guide 28;
- from input guide 28 past first print station 24;
- from first print station 24 following first plurality of guides 30 in an inward spiraling direction around and toward second print station 26;
- past second print station 26;
- from second print station 26 following second plurality of guides 32 in a an outward spiraling direction to output guide 34; and
- from output guide 34 to take-up spool 14.

Referring to FIG. 2A, web 10 has been advanced to feed print zone 20*a* past print station 24. As web 10 continues to advance, first plurality of guides 30 direct first print zone 20*a* in an inward spiraling direction around and toward second print station 26. As noted, each guide 30, for example, may be a roller positioned to contact second side 18 but not first side 16 of web 10 as first print zone 20*a* travels along the inward spiraling path. At the transition between first plurality of guides 30 and second plurality of guides 32, web 10 is inverted. Looking at FIG. 2B, web 10 has been advanced and inverted to feed print zone 20*b* past second print station 26. As web 10 continues to advance, second plurality of guides 32 direct second print zone 20*b* in an outward spiraling direction toward output guide 34. As noted, each guide 32, for example, may be a roller positioned to contact first side 16 but not second side 18 of web 10 as second print zone 20*b* travels along the outward spiraling path.

Imaging material such as ink is deposited in first print zone 20*a* as zone 20*a* is fed past first print station 24 and in second print zone 20*b* as zone 20*b* is fed past second print station 26. The positioning of first plurality of guides 30 allows first print zone 20*a* to be fed a first distance, referred to as a first drying distance, along the inward spiraling path allowing the imaging material to dry before the web is inverted and first print zone 20*a* contacts second plurality of guides 32. Likewise, the positioning of second plurality of guides 32 allows second print zone 20*b* to be fed a second distance, referred to as a second drying distance, along the outward spiraling path allowing the imaging material to dry before output guide 34 contacts second side 18 and web 10 is collected on take-up spool 14.

FIG. 3 depicts another embodiment. Imaging material drying times can differ depending upon a given application. For example, black and white text can dry more quickly than full color images. Because a web travels through a press at a generally constant velocity, drying times are translated to drying distances. In the example of FIG. 3, guides of web press 36 are positionable to vary drying distances. The term positionable as it is used in reference to guides can mean one or both of moving a guide from one location to another and adding a guide to or removing a guide from web press 36.

Web press 36 includes first print station 38 and second print station 40. Each print station 38, 40 represents generally a component or group of components configured to deposit imaging material in print zones on web 10. The imaging material, ink for example, may include one or more colors and is deposited in the form of desired images such as text and graphics. In a particular example, each print station 38 and 40 includes one or more print heads each capable of ejecting ink though selected nozzles.

Web press 36 also includes input guide 42, first plurality of guides 44, second plurality of guides 46, and output guide 48. Guides 36-48 define a path that web 10 follows through web press 36 and may represent a series of active or passive rollers sharing parallel rotational axes. In the examples of FIG. 3, web 10 travels through web press 36 as follows:

- from supply spool 12 to input guide 42;
- from input guide 42 past first print station 38;
- from first print station 38 following first plurality of guides 44 in an inward spiraling direction around and toward second print station 40;
- past second print station 40;
- from second print station 40 following second plurality of guides 46 in a an outward spiraling direction to output guide 48; and
- from output guide 48 to take-up spool 14.

After a print zone on side 16 of web 10 is advanced past first print station 38, first plurality of guides 44 direct the print zone in an inward spiraling direction around and toward second print station 40. Each guide 44, for example, may be a roller positioned to contact second side 18 but not first side 16 of web 10 as web 10 travels along the outward spiraling path. At the transition between first plurality of guides 44 and second plurality of guides 46, web 10 is inverted allowing second side 18 to be fed past second print station 40. Once fed past second print station 40, web 10 advances in an outward spiraling direction toward output guide 48. Each guide 46, for example, may be a roller positioned to contact first side 16 but not second side 18 of web 10 as web 10 travels along the outward spiraling path.

Imaging material such as ink is deposited on first side 16 of web 10 in a first print zone fed past first print station 24 and on second side 18 in a second print zone fed past second print station 26. The positioning of first plurality of guides 30 causes the first print zone to be fed a first distance, referred to as a first drying distance, along the inward spiraling path allowing the imaging material to dry before web 10 is inverted and first side 16 of web 10 contacts second plurality of guides 32. Likewise, the positioning of second plurality of guides 32 allows the second print zone to be fed a second distance, referred to as a second drying distance, along the outward spiraling path allowing the imaging material to dry before output guide 34 contacts second side 18 and web 10 is collected on take-up spool 14.

Web press 50 includes additional guide positions 50 where additional guides may be added or existing guides repositioned. Of note is the "X" pattern formed by guide positioned 50 and first and second plurality of guides 44 and 46 with second print station 40 positioned at its center. Guides 42-48 are positionable to define one or more of (a) a variable drying distance for first side 16 as web 10 is fed between the first print station and the second print station and (b) a variable drying distance for second side 18 as web 10 is fed from second print station. For example, additional guides could be added to increase a particular drying distance. Guides may be removed to decrease a particular drying distance.

Operation: FIG. 4 is an exemplary flow diagram of steps taken to implement an embodiment. In discussing FIG. 4, reference may be made to the diagrams of FIGS. 1-3 to provide contextual examples. Implementation, however, is not limited to those examples.

A first print zone on a first side of a web is fed past a first print station (step 52). Looking back to FIG. 2A, first print zone 20*a* is fed past first print zone 24. Looking at FIG. 3, a print zone on side 16 of web 10 is fed past first print station 38. The first print zone is then fed from the first print station in an inward spiraling direction around and toward a second print station (step 54). In FIG. 2A, first plurality of guides 30 are positioned to direct first print zone 20*a* in an inward spiraling direction. In FIG. 3, that responsibility falls on first plurality of guides 44, A second print zone is fed past a second printing station (step 58). The second print zone is located opposite the first print zone on the other side of the web. Looking at FIG. 2B, second print zone 20*b* on second side 18 of web 10 is fed past second print station 26. Looking at FIG. 3, a print zone on second side 18 of web 10 is fed past second print station 40. The second print zone is then fed from the second print station in an outward spiraling direction (step 60). In FIG. 2B, second plurality of guides 32 are positioned to direct second print zone 20*b* along the outward spiraling path. In FIG. 3, that responsibility falls on second plurality of guides 46.

Step 54 can include feeding the web such that the second side, but not the first side, contacts a first plurality of guides during at least an inward spiral of the first print zone around the second print station. Imaging material may be deposited in the first print zone as that zone is fed past the first print station in step 52. Step 54 can includes feeding the web a first distance between the first and second print stations such that the imaging material deposited on the first print zone has time to at least substantially dry before the first print zone contacts one of the second plurality of guides. FIG. 2A provides an example. Further, feeding the first print zone in step 54 can include feeding the web around a first plurality of guides that are selectively positionable to define a variable drying distance between the first print station and the second print station.

Likewise, step 60 can include feeding the web such that the first side, but not the second side, contacts a second plurality of guides during an outward spiral of the second print zone around the second print station. Imaging material may be deposited in the second print zone as that zone is fed past the first print station in step 58. Step 60 can include feeding the web a second distance past the second print station such that the imaging material deposited on the second print zone has time to at least substantially dry before the second print zone contacts an output guide. FIG. 2B provides an example. Further, feeding the second print zone in step 60 can include feeding the web around a second plurality of guides that are selectively positionable to define a variable drying distance extending from the second print station.

Conclusion: The present invention has been shown and described with reference to the foregoing exemplary embodiments. FIGS. 1-3 show the architecture, functionality, and operation of various exemplary embodiments. The exemplary embodiments are just that—exemplary. It is to be understood, however, that other forms, details and embodiments may be made without departing from the spirit and scope of the invention that is defined in the following claims. Although the flow diagram of FIG. 4 shows a specific order of execution, the order of execution may differ from that which is depicted. For example, the order of execution of two or more blocks may be scrambled relative to the order shown. Also, two or more blocks shown in succession may be executed concurrently or with partial concurrence. All such variations are within the scope of the present invention.

What is claimed is:

1. A method for transporting a web through a press, the web having a first print zone on a first side and a second print zone on a second side opposite the first print zone, the method comprising:

feeding the first print zone past a first print station where imaging material is deposited on the first print zone and then feeding the first print zone in an inward spiraling direction around and toward a second print station; and feeding the second print zone past the second print station, different from the first print station, where imaging material is deposited on the second print zone and then feeding the second print zone in an outward spiraling direction around and away from the second print station.

2. The method of claim 1, wherein:

feeding the first print zone in an inward spiraling direction comprises feeding the web such that the second side, but not the first side, contacts a first plurality of guides during at least an inward spiral of the first print zone around the second print station; and feeding the second print zone in an outward spiraling direction comprises feeding the web such that the first side, but not the second side, contacts a second plurality of guides during an outward spiral of the second print zone around the second print station.

3. The method of claim 2:

wherein feeding the first print zone in an inward spiraling direction comprises feeding the web a first distance between the first and second print stations such that the imaging material deposited on the first print zone has time to at least substantially dry before the first print zone contacts one of the second plurality of guides.

4. The method of claim 3, wherein feeding the second print zone in an outward spiraling direction comprises feeding the web a second distance past the second print station such that the imaging material deposited on the second print zone has time to at least substantially dry before the second print zone contacts an output guide.

5. The method of claim 1, wherein feeding the first print zone in an inward spiraling direction around and toward a second print station comprises feeding the web around a first plurality of guides, and wherein the first plurality of guides are selectively positionable to define a variable drying distance between the first print station and the second print station.

6. The method of claim 1, wherein feeding the second print zone in an outward spiraling direction around and away from the second print station comprises feeding the web around a second plurality of guides, and wherein the second plurality of guides are selectively positionable to define a variable drying distance extending from the second print station.

7. A system for transporting a web through a press, the web having first print zone on a first side and a second print zone on a second side opposite the first print zone, the system comprising:

a first plurality of guides positioned to allow the first print zone to be fed past a first print station and then in an inward spiraling direction around and toward a second print station; and a second plurality of guides positioned to allow the second print zone to be fed past the second print station and then in an outward spiraling direction around and away from the second print station.

8. The system of claim 7, wherein:

the first plurality of guides are positioned such that the second side, but not the first side, contacts the first plurality of guides during an inward spiral of the first print zone around the second print station; and the second plurality of guides are positioned such that the first side, but not the second side, contacts the second plurality of guides during an outward spiral of the second print zone around the second print station.

9. The system of claim 7, wherein the first plurality of guides are positioned define an inward spiraling web path extending a first distance between the first and second print stations such that the imaging material deposited on the first print zone when passing the first print station has time to at least substantially dry before the first print zone contacts one of the second plurality of guides.

10. The system of claim 7, further comprising an output guide, and wherein the second plurality of guides are positioned to define an outward spiraling web path extending a second distance past the second print station such that the imaging material deposited on the second print zone when passing the second print station has time to at least substantially dry before the second print zone contacts an output guide.

11. The system of claim 7, wherein one or more of the output guide, the first plurality of guides, and the second plurality of guides are selectively positionable to define one or more of:

a variable drying distance between the first print station and the second print station; and a variable drying distance extending from the second print station.

12. A web press, comprising a first print station, a second print station, an input guide, a first plurality of guides, and a second plurality of guides, and an output guide, wherein:

the first print station is positioned to selectively dispense imaging material on a first print zone located on a first side of a web;

the second print station is positioned to selectively dispense imaging material on a second print zone opposite the first print zone on a second side of the web opposite the first print zone;

the input guide is positioned to allow the first print zone to be fed into the first print station;

the first plurality of guides are positioned to allow the first print zone to be fed from the first print station in an inward spiraling direction around and into the second print station;

the second plurality of guides are positioned to allow the second print zone to be fed from the second print station in an outward spiraling direction around the second print station to the output guide.

13. The web press of claim 12, wherein:

the first plurality of guides are positioned such that the second side, but not the first side, contacts the first plurality of guides during an inward spiral of the first print zone around the second print station; and the second plurality of guides are positioned such that the first side, but not the second side, contacts the second plurality of guides during an outward spiral of the second print zone around the second print station.

14. The system of claim 12, wherein:

the first plurality of guides are positioned define an inward spiraling web path extending a first distance between the first and second print stations such that the imaging material deposited on the first print zone when passing the first print station has time to at least substantially dry before the first print zone contacts one of the second plurality of guides; and the second plurality of guides are positioned to define an outward spiraling web path extending a second distance past the second print station such that the imaging material deposited on the second print zone when passing the second print station has time to at least substantially dry before the second print zone contacts the output guide.

15. The system of claim 12, wherein one or more of the input guide, the first plurality of guides, the second plurality of guides, and the output guide are selectively positionable to define one or more of:

a variable drying distance between the first print station and the second print station; and a variable drying distance extending from the second print station.

* * * * *